US005979174A

United States Patent [19]

Kim et al.

[11] Patent Number: 5,979,174

[45] Date of Patent: Nov. 9, 1999

[54] REFRIGERATED AIR SUPPLY APPARATUS FOR REFRIGERATOR

[75] Inventors: Seok Ro Kim; San Ho Park; Kyung Seok Yoon; Gyoo Jong Bae, all of Kyungnam; Sung Ho Shin, Pusan, all of Rep. of Korea

[73] Assignee: LG Electronics Inc., Seoul, Rep. of Korea

[21] Appl. No.: 09/085,007

[22] Filed: May 28, 1998

[30] Foreign Application Priority Data

| | | | |
|---|---|---|---|
| May 28, 1997 | [KR] | Rep. of Korea | 97-12222 |
| May 28, 1997 | [KR] | Rep. of Korea | 97-21269 |
| May 28, 1997 | [KR] | Rep. of Korea | 97-21270 |
| May 29, 1997 | [KR] | Rep. of Korea | 97-21668 |
| Jun. 10, 1997 | [KR] | Rep. of Korea | 97-23845 |
| Jun. 10, 1997 | [KR] | Rep. of Korea | 97-23846 |
| Jul. 2, 1997 | [KR] | Rep. of Korea | 97-30575 |

[51] Int. Cl.[6] ..... F25D 17/04; F25D 17/08; F25D 11/02

[52] U.S. Cl. ..... 62/404; 62/405; 62/413; 62/444

[58] Field of Search ..... 62/404, 405, 407, 62/408, 413, 418, 419, 444

[56] References Cited

U.S. PATENT DOCUMENTS

| | | | |
|---|---|---|---|
| 5,584,191 | 12/1996 | Kwon | 62/417 |
| 5,737,935 | 4/1998 | Heo | 62/186 |
| 5,768,909 | 6/1998 | Jeong et al. | 62/408 |
| 5,787,725 | 8/1998 | Shin | 62/443 |

*Primary Examiner*—Henry Bennett
*Assistant Examiner*—Melvin Jones

[57] ABSTRACT

A refrigerator includes a fresh food compartment, a freezer compartment defined by inner walls and an outer case respectively, an insulation barrier separating the compartments, and doors for providing access to the compartments. A passageway is formed in the barrier for providing refrigerated air to the fresh food compartment. A connecting duct diverges from the passageway and extends forwardly towards the front portion of the fresh food compartment. A door duct communicating with the connecting duct when the door is closed is coupled to the door. As a result, the fresh food compartment and door-adjacent portions of the fresh food compartment are promptly and uniformly cooled.

22 Claims, 9 Drawing Sheets

REFRIGERATED AIR SUPPLY APPARATUS FOR REFRIGERATOR

BACKGROUND OF THE INVENTION

1. Field of the Invention

This invention relates to a refrigerator, and more particularly to a refrigerated air supply apparatus for effectively distributing refrigerated air to different parts of the refrigerator.

2. Description of Background Art

As shown in FIGS. 1 and 2, conventional refrigerators have a freezer compartment 10 and a fresh food compartment 20 partitioned by an insulation barrier 5. The compartments 10, 20 are defined by inner cases 12, 22 respectively surrounded by an insulation material 7 which is cased by an outer case 2. A fan unit 4 for supplying refrigerated air to the freezer compartment 10 and fresh food compartment 20 is mounted in an evaporating chamber 11 provided at the rear portion of the freezer compartment 10. An evaporator 8 for generating refrigerated air is also provided in the evaporating chamber 11. The compartments 10, 20 are respectively closed by doors, 19, 29 hinged in front of the refrigerator. The door 29 has door baskets 26 mounted at inner surfaces thereof for storing food therein.

Conventional refrigerated air circulation will be explained in view of FIGS. 1 and 2. In a refrigeration cycle, refrigerated air is generated by the evaporator 8 in which a working fluid or refrigerant flows. As the fan unit 4 operates, a portion of the refrigerated air flows to the freezer compartment 10, and another portion of the refrigerated air impinges on a grill 16 and is guided to a fresh food duct 24 through a passage 15 defined by a shroud 14 and the grill 16. The refrigerated air guided to the fresh food duct 24 is then blown into the fresh food compartment 20 through a plurality of outlets 25 formed in the front surface thereof, as indicated by the arrows in FIG. 2.

Refrigerated air supplied to the fresh food compartment 20, via the above-mentioned supply path, then moves forward and carries out heat exchange with the food stored in the fresh food compartment 20, thereby becoming relatively warm. The warmed air returns to the evaporating chamber 11 through a return duct 30 formed in the insulation barrier 5 with its inlet 31 adjacent to the door 29. The warmed air in the evaporating chamber 11 carries out heat exchange with the evaporator 8, thereby becoming refrigerated air again.

But the above-described conventional refrigerated air circulation system has a number of problems. First, it lacks the effective uniform cooling of the fresh food compartment 20 since the refrigerated air is provided only in one direction, i.e., forward direction, from the outlets 25 of fresh food duct 24. This means that the temperature of a portion adjacent to the outlets 25 is lower than that of a portion adjacent to the door 29. Therefore, any food stored adjacent to the outlets 25 may be over-refrigerated while any food stored adjacent to the door 29 tends to be under-refrigerated.

Second, the temperature at the door-adjacent portion in the fresh food compartment 20 tends to increase as time passes due to the frequent opening of the door 29. As a result, it takes greater energy and longer time to maintain the temperature of the door-adjacent portion than to maintain the temperature of the portion adjacent to the fresh food duct 24 since refrigerated air is only provided by the fresh food duct 24.

Third, it is difficult to keep the food stored in the door baskets 26 to the temperature desired due to an inflow of warm air from the outside when the door 29 is opened.

An improved refrigerated air circulation system was described in U.S. Pat. No. 5,584,191 issued Dec. 17, 1996. According to this air circulation system, refrigerated air is blown into the fresh food compartment by a cool air duct mounted at the comer of the fresh food compartment and by a door duct which receives the refrigerated air through a transmission duct mounted on a side wall. The transmission duct is exposed to the interior of the fresh food compartment and only delivers refrigerated air which has been spouted out in the fresh food compartment through the cool air duct to the door duct. This air circulation system, however, still has some problems although it improves the uniform refrigerating effect by the spouting the refrigerated air from the door duct.

One problem with the circulation system of U.S. Pat. No. 5,584,191 is that the transmission duct occupies a certain space in the fresh food compartment where food is stored so that a substantial storage space in the fresh food compartment cannot be used because of the presence of transmission duct. Another problem is that the amount of refrigerated air spouted by the door duct is not sufficient since the refrigerated air delivered through the transmission duct is provided to the cool air duct. Still another problem is that a large temperature difference between the fresh food compartment and the interior of the transmission duct causes dewing and freezing on the surface of the transmission duct.

SUMMARY OF THE INVENTION

It is an object of the invention to provide an improved refrigerated air supply apparatus that provides refrigerated air uniformly in the fresh food compartment.

It is another object of the invention to provide prompt cooling of a portion adjacent to the door of a refrigerator.

It is still another object of the invention to provide an improved air supply apparatus that provides sufficient refrigerated air to the door adjacent portion to keep foods stored in the door baskets fresh.

In accordance with one example of the present invention, a refrigerated air supply apparatus includes means for generating refrigerated air, a passageway for guiding the refrigerated air through an insulating layer, a fresh food duct for providing the refrigerated air into a fresh food compartment from the passageway, a connecting duct diverging from the passageway in the insulation layer and extending forward to the front of the fresh food compartment in the insulated state, and a door duct mounted in the door for spouting refrigerated air through the connecting duct into the fresh food compartment.

In accordance with another example of the invention, a refrigerated air supply apparatus includes means for generating refrigerated air, a passageway for guiding the refrigerated air through an insulating layer, a fresh food duct for providing the refrigerated air into a fresh food compartment from the passageway, a connecting duct diverging from the uppermost part of the fresh food duct and extending forward to the front of the fresh food compartment, and a door duct mounted in the door for spouting the refrigerated air through the connecting duct into the fresh food compartment.

BRIEF DESCRIPTION OF THE DRAWINGS

The foregoing objects and advantages will be more fully understood by reading the Detailed Description of the Preferred Embodiments with reference to the drawings wherein.

DETAILED DESCRIPTION OF THE PREFERRED EMBODIMENTS

Figure 1:
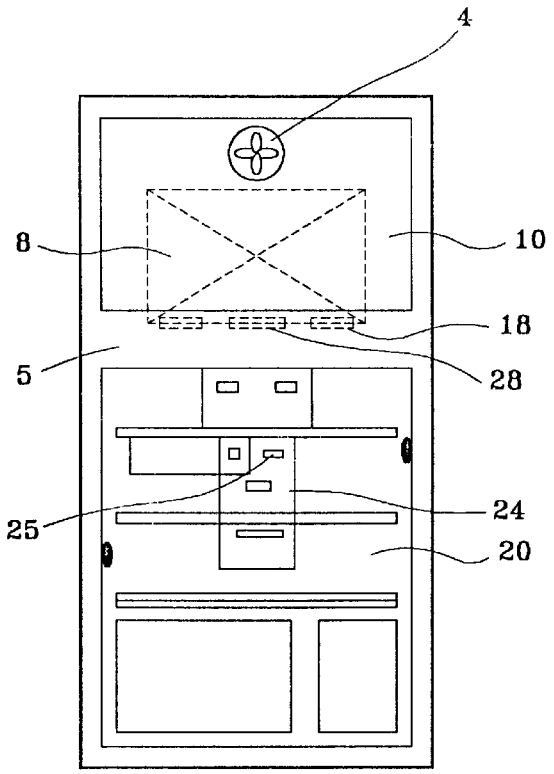
FIG. 1 is a front view of a conventional refrigerator with the door opened.
Figure 2:
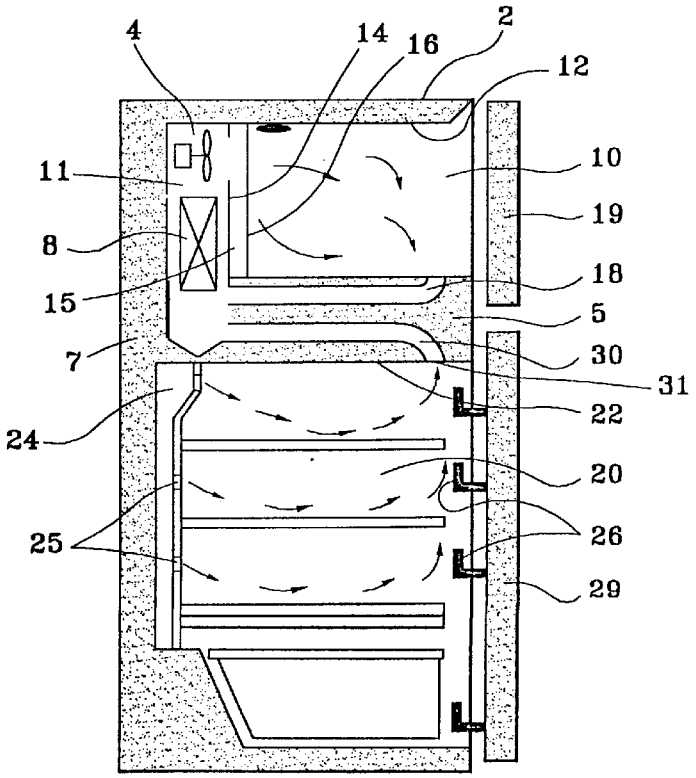
FIG. 2 is a side section view of the conventional refrigerator showing a conventional refrigerated air circulation.
Figure 3:
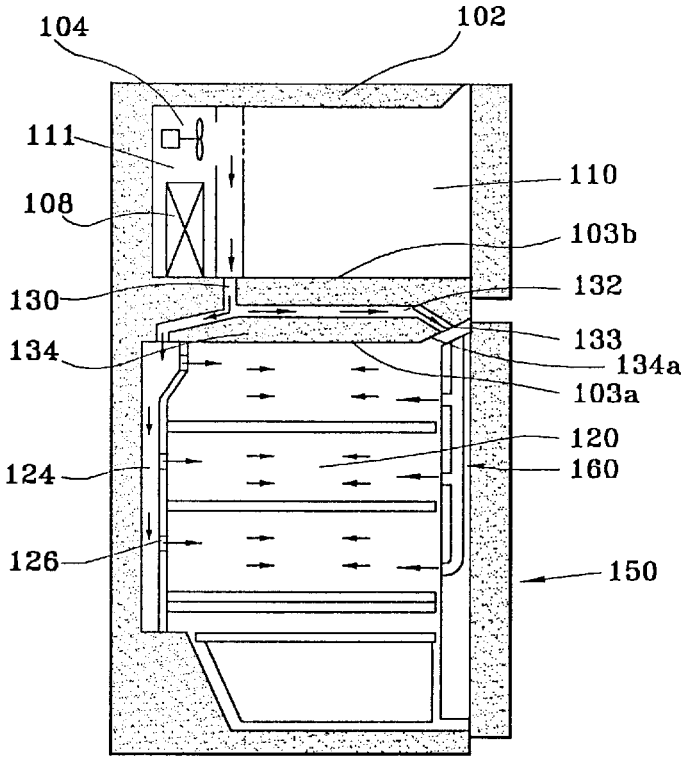
FIG. 3 is a side section view of a refrigerator in accordance with a first embodiment of the invention.

As shown in FIG. 3 where the first embodiment of the invention illustrated, a refrigerator of the invention has a freezer compartment 110 and a fresh food compartment 120 partitioned by an insulation barrier 134. A refrigerated air supply apparatus of the invention includes a connecting duct 132 which diverges in different directions from a passageway 130 within the insulation barrier 134. The connecting duct 132 provides the refrigerated air to a door duct 160 provided in a door 150 so that the door duct 160 transfers the refrigerated air into the fresh food compartment 120, thereby achieving uniform cooling of the fresh food compartment 120. The passageway 130 can be a duct, a path, or any other member which flows the refrigerated air from a refrigerating chamber 111 to the fresh food compartment 120, and includes all conventional mechanisms and ways to transfer the refrigerated air.

In the first embodiment shown in FIG. 3, the connecting duct 132 diverges within the interior of the insulation barrier 134 from the passageway 130. The connecting duct 132 extends to the front portion of the refrigerator and has an outlet 133 formed on the front portion of a lower wall 134*a* of the barrier 134. The outlet 133 of the connecting duct 132 is adjacent to the door 150 which provides access to the fresh food compartment 120. Since the connecting duct 132 is mounted in the interior of the barrier 134, it does not occupy any space in the fresh food compartment 120. The storage space, therefore, in the fresh food compartment 120 can be fully utilized.

Figure 4:
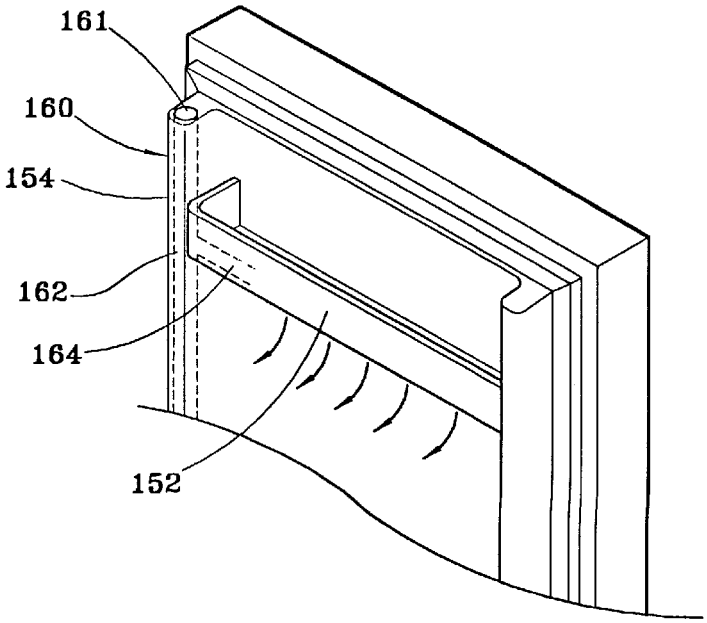
FIG. 4 is a partial perspective view of the door of the refrigerator in accordance with the first embodiment of the invention.
Figure 5:
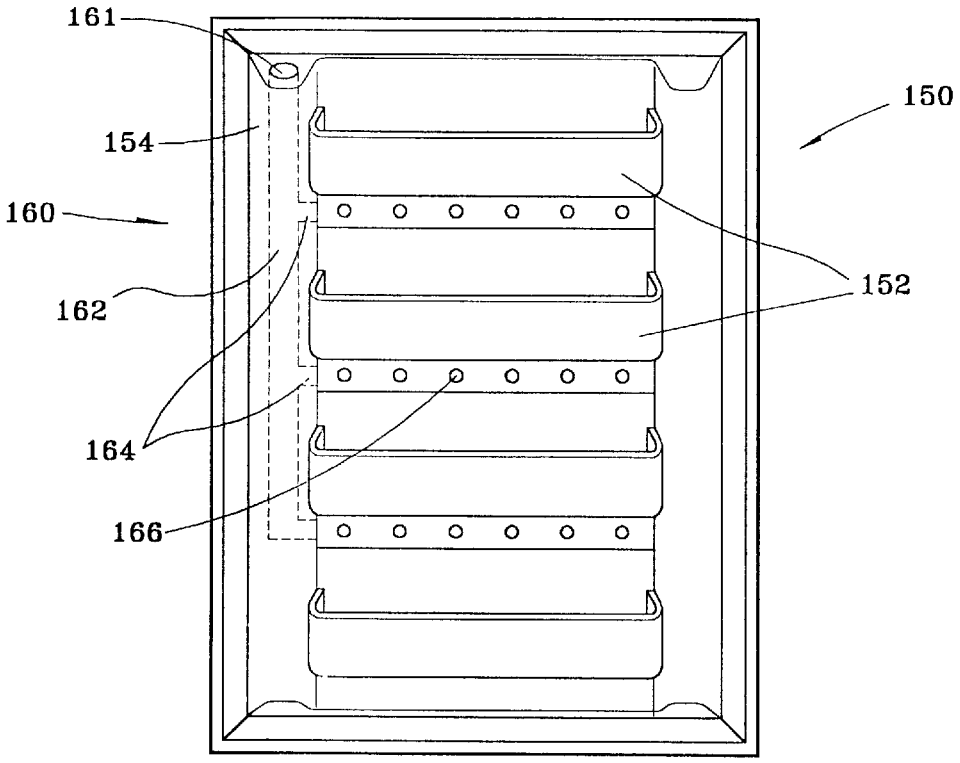
FIG. 5 is a front view of the door of the refrigerator in accordance with the first embodiment of the invention showing a door duct.

As illustrated in FIGS. 4 and 5, the door duct 160 is provided in the door 150, which receives the refrigerated air from the passageway 130 through the connecting duct 132. The door duct 160 has an inlet 161 which communicates with the outlet 133 of the connecting duct 132 and receives the refrigerated air therefrom when the door 150 is closed. In this embodiment, the inlet 161 is formed at the upper portion of the door liner 154, and the refrigerated air provided via the connecting duct 132 flows downwardly in the door duct 160. The door duct 160 has a vertical portion 162 which is communicated with the inlet 161, and a plurality of horizontal portions 164 which are communicated with the vertical portion 162. The horizontal portions 164 are provided with a plurality of outlet openings 166 to spout the refrigerated air into the fresh food compartment 120.

Refrigerated air provided into the door duct 160 flows into the fresh food compartment 120 through the outlet openings 166 so that the door-adjacent portion in the fresh food compartment 120, which tends to be easily warmed due to the frequency opening of the door 150, is chilled promptly. In this embodiment illustrated, the horizontal portions 164 of the door duct 160 are positioned under the door baskets 152, but they can be positioned at other locations. Refrigerated air spouted from the outlet openings 166 of the door duct 160 passes across the food stored in the door baskets 152, and then flows into the interior of the fresh food compartment 120. The food stored in the door baskets 152 is exposed to the spouting refrigerated air and is kept fresh thereby. Preferably, the door duct 160 is formed integrally with the door baskets 152 but can be formed in other ways. The outlet openings 166 may be formed so that the refrigerated air flows rearwardly and directly into the fresh food compartment 120 or in a manner so that refrigerated air flows into the fresh food compartment 120 across the food stored in the door baskets 152. Also preferably, the door duct 160 may be mounted in the interior of the door baskets 152.

Refrigerated air supply path will be explained hereinafter with reference to FIGS. 3–5. A portion of refrigerated air generated by the evaporator 108 in the refrigerating chamber 111 is directed to the freezer compartment 110 and another portion of the refrigerated air is directed to the fresh food compartment 120 through the passageway 130 by the fan unit 104.

Refrigerated air guided to the passageway 130 is then divided into two or more portions by the connecting duct 132. A portion of the divided refrigerated air is provided into a fresh food duct 124 mounted at the rear portion of the fresh food compartment 120, while another portion of refrigerated air is provided into the door duct 160 through the connecting duct 132. Refrigerated air in the fresh food duct 124 is spouted into the fresh food compartment 120 forwardly through a plurality of outlets 126 as indicated by arrows in FIG. 3. The refrigerated air in the connecting duct 132 flows forwardly to the outlet 133 thereof and then, flows into the door duct 160 through the inlet 161 communicating with the outlet 133 in the door-closed state. In the interior of the door duct 160, the refrigerated air flows downwardly along the vertical portion 162 and is distributed to the horizontal portions 164. Then the refrigerated air is spouted into the fresh food compartment 120 in the rearward direction through the outlet openings 166.

It will be understood that refrigerated air is spouted into the fresh food compartment 120 forwardly by the fresh food duct 124 and rearwardly by the door duct 160, respectively. The interior of the fresh food compartment 120 is, therefore, uniformly supplied with new refrigerated air.

Refrigerated air provided into the fresh food compartment 120 performs heat exchange with the foodstuffs stored therein, so as to become relatively warmed air. The warmed air is returned to the evaporating chamber 111 having the evaporator 108 through a return duct (not shown) and transformed into refrigerated air again by the heat exchange with the evaporator 108.

In the embodiment illustrated and explained above, the connecting duct 132 diverges from the passageway 130 into different directions in the insulation barrier 134. The barrier 134 is a partition defined by an inner wall 103*b* of freezer compartment 110 and an inner wall 103*a* of fresh food compartment 120 in which an insulation material, such as urethane, is filled. This means that the connecting duct 132 according to the invention does not occupy any space in the fresh food compartment 120 so that the inner space of the fresh food compartment 120 can be fully utilized for food storage.

The second embodiment of the invention will be described hereinafter with reference to FIGS. 6–8. According to the second embodiment, a connecting duct 232 is mounted in the interior of an insulation barrier 234 and in the interior of a side wall 228 defined by an inner side wall 227 of a fresh food compartment 220 and an outer case 229.

The connecting duct 232 in the insulation barrier 234 diverges from a passageway 230 which is a duct, a path, or the like for delivering refrigerated air to a fresh food duct 224. The connecting duct 232 extends forwardly through the interior of the barrier 234 and the side wall 228, and has an outlet 233 formed at the front side surface of the side wall 228.

Diverging from the passageway 230, the connecting duct 232 extends forwardly through the interior of the side wall 228 to the front side surface thereof. The side wall 228, defined by the inner side wall 227 of fresh food compartment 220 and the outer case 229, is substantially filled with an insulation material. Also in this embodiment, the connecting duct 232 does not occupy any storage space in the fresh food compartment 220 because it is provided in the interior of the side wall 228.

Figure 6:
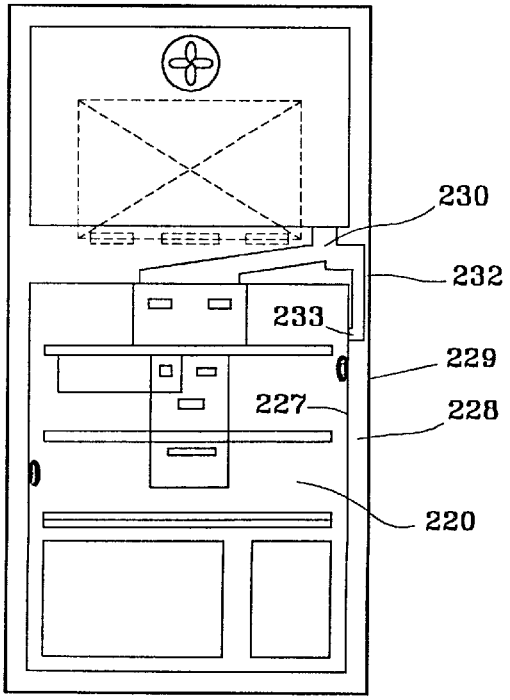
FIG. 6 is a front view of a refrigerator in accordance with a second embodiment of the invention with its door removed.
Figure 7:
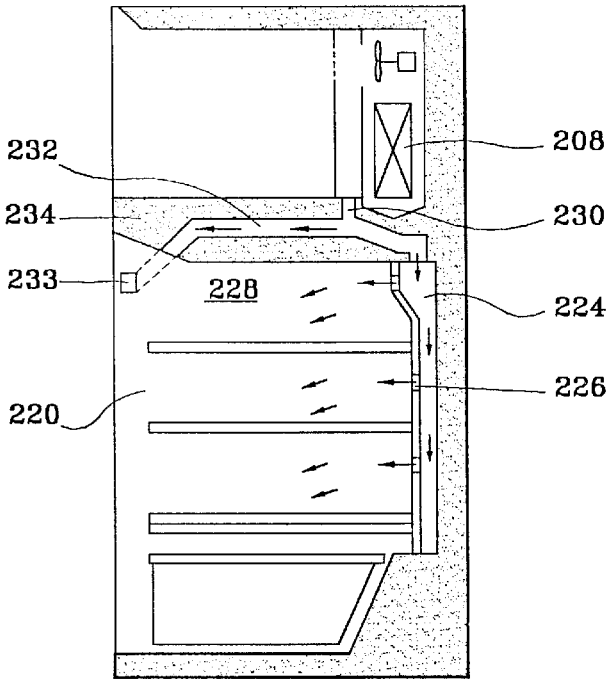
FIG. 7 is a side section view of the refrigerator shown in FIG. 6 with the door removed.
Figure 8:
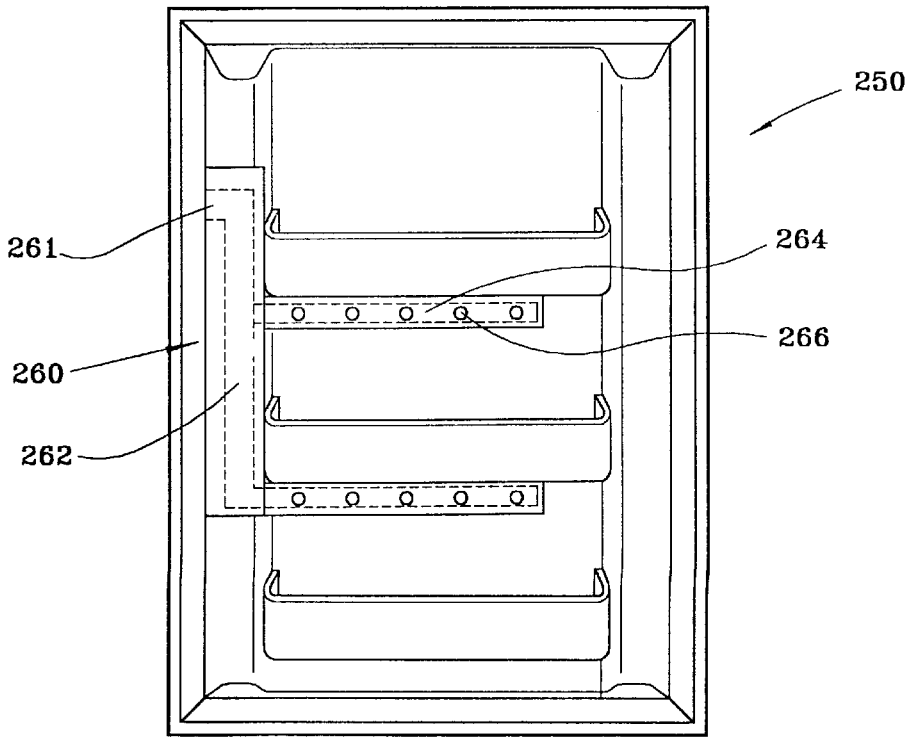
FIG. 8 is a front view of the door of the refrigerator in accordance with the second embodiment of the invention.

As shown in FIG. 8, a door duct 260 is provided in the door 250 of the refrigerator shown in FIG. 6. The inlet 261 formed on a side wall of the door 250 communicates with the outlet 233 of the connecting duct 232 when the door 250 is closed. The door duct 260 is provided with a vertical portion 262 and a plurality of horizontal portions 264 with a plurality of outlet openings 266. The function of the door duct 260 is substantially the same as the function of the door duct in the first embodiment as described above, except that it is provided with the inlet 261 opened up facing the side surface thereof.

Refrigerated air generated by an evaporator 208 is distributed to the fresh food duct 224 and door duct 260 through the passageway 230 and connecting duct 232. Similarly, refrigerated air is spouted into the fresh food compartment 220 forwardly through a number of outlets 226 of the fresh food duct 224 and rearwardly through a number of outlet openings 266 of door duct 260. The interior of the fresh food compartment 220 is therefore uniformly supplied with new refrigerated air.

It will also be understood that the connecting duct 232 of the embodiment is provided in the side wall 228 and barrier 234 of the refrigerator in the insulated state without occupying any storage space in the fresh food compartment 220.

Figure 9:
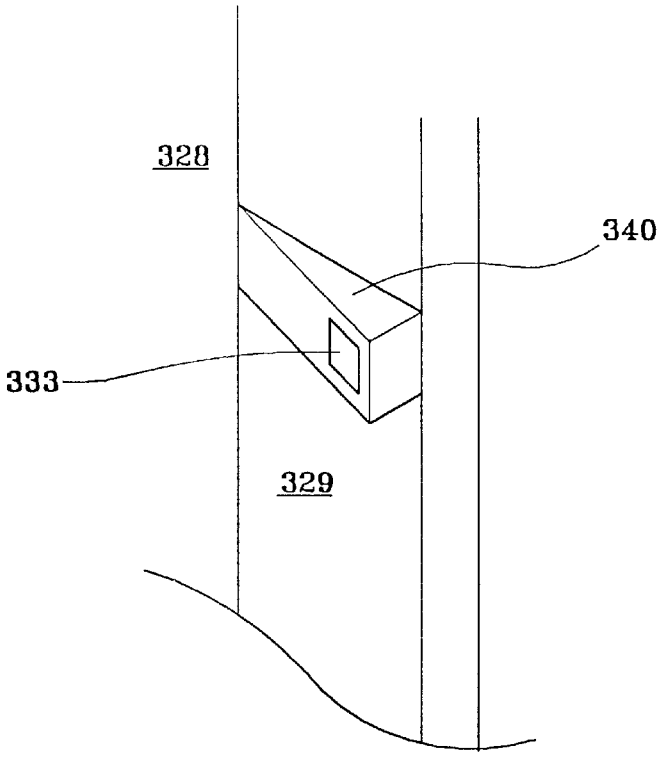
FIG. 9 is a partial perspective view of a connecting portion with a door duct of the present invention.
Figure 10:
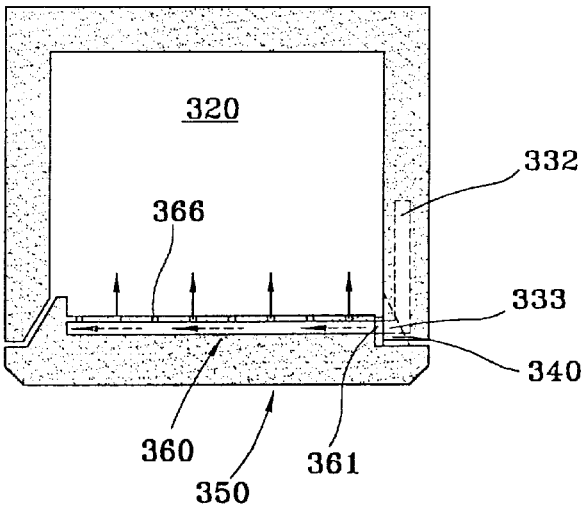
FIG. 10 is a horizontal section view of a refrigerator having the connecting portion shown in FIG. 9.

Another example of a connection between a connecting duct and a door duct according to the present invention will be described with reference to FIGS. 9 and 10.

This example disclose a connecting structure where refrigerated air in a connecting duct is delivered to a door duct without leakage. As shown in FIGS. 9 and 10, a connecting member 340 is mounted on an inclined front surface 329 of fresh food compartment 320. An outlet 333 of connecting duct 332 is formed in the connecting member 340. A door duct 360 which has the same function and structure of a door duct as explained above is mounted in a door 350 of a refrigerator. The door duct 360 is provided with an inlet 361 which is formed on the side surface of the door 350 to communicate with the outlet 333 of the connecting duct 332 when the door 350 is closed. The connecting member 340 is protruded laterally toward the door 350 and is formed with a resilient material to have close contact with the door 360 when the door 350 is closed. The connecting member 340 may be formed integrally with the inclined front surface 329 of the refrigerator.

According to this example, the connecting member 340 having the outlet 333 of connecting duct 332 provides close contact with the side surface of the door 350 where the inlet 361 of door duct 360 is formed. The refrigerated air which flows in the connecting duct 332 will be delivered to the door duct 360 without air leakage. The refrigerated air is generated and introduced to the connecting duct 232 as in the first and second embodiments or as known conventionally.

It will be understood that the connecting member 340 can provide close contact between the connecting duct 332 and door duct 360 to prevent air leakage. Various modifications in the contour and design of the connecting member 340 are possible. Further, the connecting member 340 may be used in conjunction with a door of a freezing compartment of a refrigerator.

Figure 11:
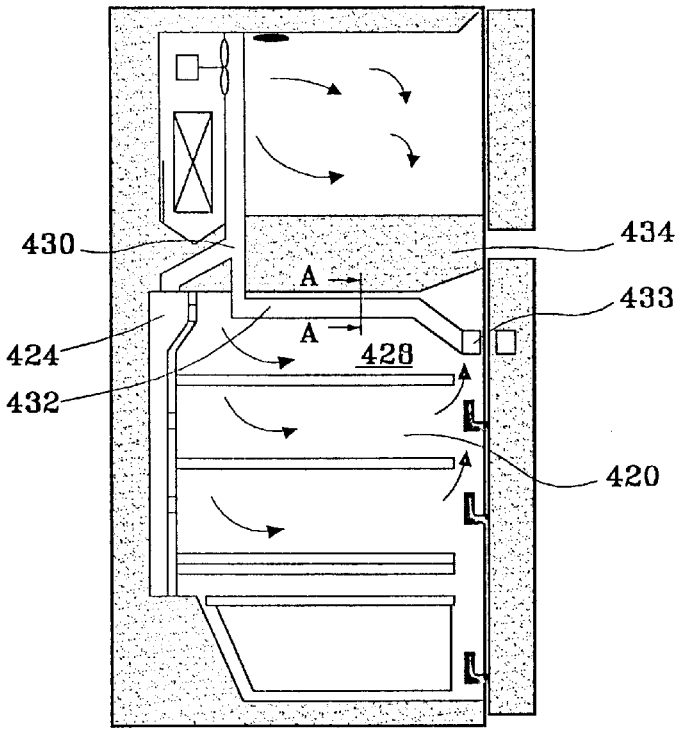
FIG. 11 is a side section view of a refrigerator in accordance with a third embodiment of the invention.
Figure 12:
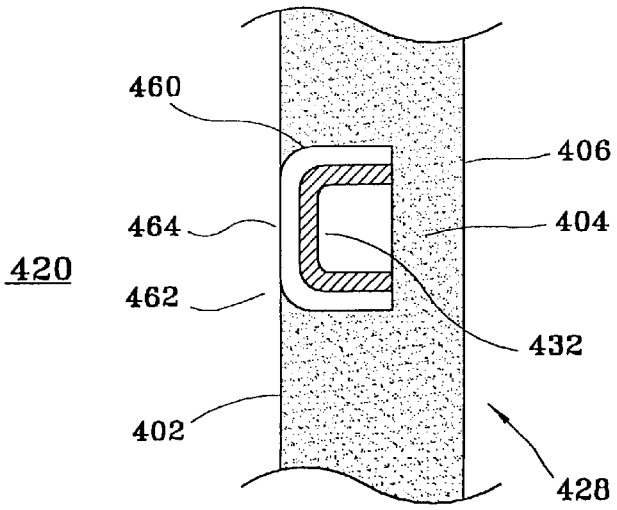
FIG. 12 is a section view taken substantially along the line A—A in FIG. 11.

Next, the third embodiment will be described with reference to FIGS. 11 and 12. According to the third embodiment, a connecting duct 432 is mounted along an inner side wall 428 of fresh food compartment 420. As described above and shown in FIG. 11, the connecting duct 432 diverges from a passageway 430 in an insulation barrier 434 which is a duct or a path for guiding refrigerated air to a fresh food compartment 424. The inner side wall 402 is provided with a groove 460 as shown in FIG. 12 in which the connecting duct 432 is inserted. The groove 460 extends forwardly along the inner side wall 402. The connecting duct 432 is mounted in the groove 460 not to protrude inwardly in the fresh food compartment 420. The connecting duct 432 mounted in the groove 460 is surrounded by an insulation layer 464 which is cased by a cover 462. The connecting duct 432 is provided with its outlet 433 at the front surface of the side wall 428 of the refrigerator, which communicates with an inlet of door duct (not shown) described and illustrated above. The connecting duct 432 is laid in the side wall 428 of the fresh food compartment 420 and surrounded by the insulation layer 464.

In the manufacturing process of this embodiment, the inner wall 402, an outer case 404 and an insulation 406 will be prepared according to conventional methods, except that the inner side wall 402 is provided with the groove 460. Therefore, the structure of the connecting duct 432 in this embodiment can be easily applied to conventional refrigerators.

When the cabinet of a refrigerator is prepared by a conventional method, the connecting duct 432 having a U-section or pipe type section is assembled to the groove 460 of inner wall 403. Then the assembling process will be finished by assembling the insulation layer 464 and cover 462 on the connecting duct 432.

It will be understood that according to this embodiment, the connecting duct 432 also does not occupy any storage space in the fresh food compartment 420. And conventional problems due to a temperature difference between the connecting duct 432 and fresh food compartment 420 will be overcome since the connecting duct 432 is covered with the insulation layer 464. And as stated above, this embodiment may be easily applied to the conventional refrigerators since it does not require any structural changes except the change to the inner side wall 402.

Figure 13:
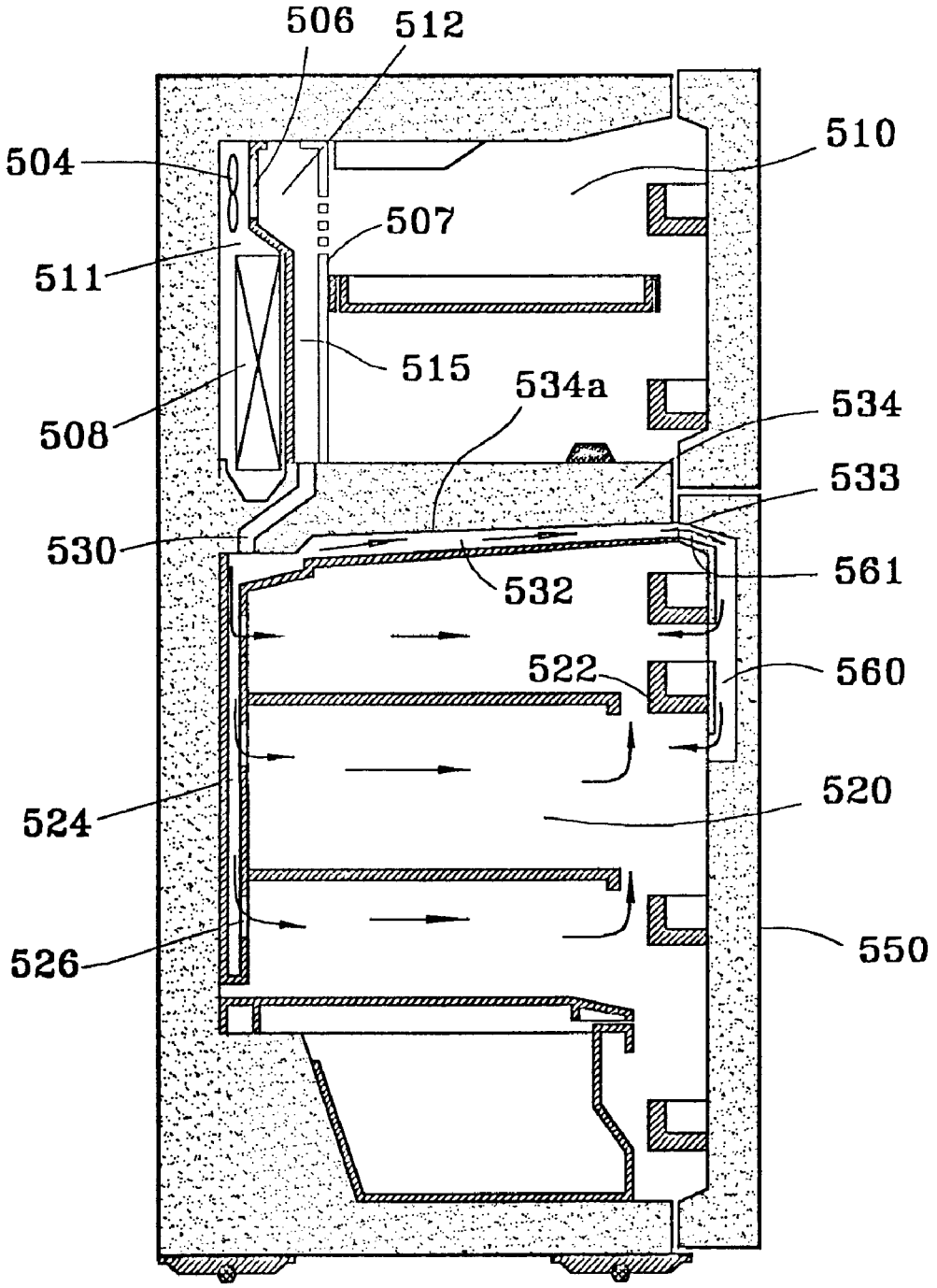
FIG. 13 is a side section view of a refrigerator in accordance with a fourth embodiment of the invention.
Figure 14:
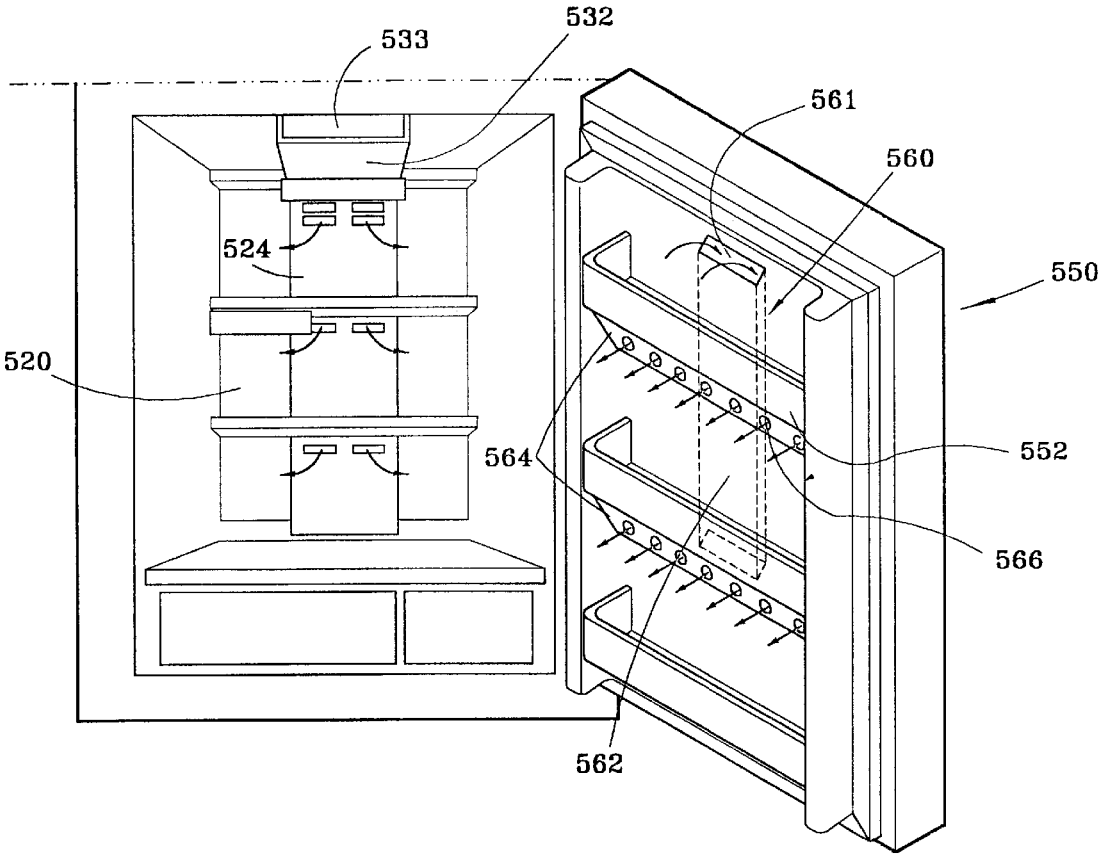
FIG. 14 is a partial perspective view of a refrigerator in accordance with the fourth embodiment of the invention with its door opened.

The fourth embodiment of the invention will be explained with reference to FIGS. 13 and 14. In this embodiment, the refrigerator is divided into a freezer compartment 510 and a fresh food compartment 520 by an insulation barrier 534. A fresh food duct 524 is mounted vertically at the rear wall of fresh food compartment 520 and provided with a plurality of outlet openings 526 to spout refrigerated air into the fresh food compartment 520. A refrigerating chamber 511 is provided at the rear of the freezer compartment 510 where an evaporator 508 and a fan unit 504 are mounted.

Refrigerated air generated by the evaporator 508 is provided into the fresh food duct 524 through a passageway 530 mounted in the barrier 534. The passageway 530 communicates with a duct or space 515 defined by a shroud 506 and a grill 507.

A connecting duct 532 of this embodiment diverges at the uppermost portion of the fresh food duct 524 and is mounted against the lower wall 534*a* of barrier 534. The connecting duct 532 extends forwardly along the lower wall 534*a* and has an outlet 533 located at the front portion of the fresh food compartment 520.

A door duct 560 is mounted in the door 550 which closes the fresh food compartment 520. An inlet 561 of the door duct 560 is formed in the upper portion of the door 550, which communicates with the outlet 533 of connecting duct 532 when the door 550 is closed, as shown in FIG. 14. The door duct 560 has a vertical portion 562 which communicates with the inlet 561, and a plurality of horizontal portions 564 which communicate with the vertical portion 562. A plurality of outlet openings 566 are formed at the front surface of the horizontal portions 564. Refrigerated air flown into the door duct 560 through the connecting duct 532 is spouted into the fresh food compartment 520 by the outlet openings 566, thereby cooling the door adjacent portions sufficiently in the fresh food compartment 520.

Similar to the first embodiment, the outlet openings of 566 of the door duct 560 are formed so that refrigerated air spouted from the openings 566 passes through the food stored in the door baskets 552. Also similarly, the horizontal portions 564 may be formed integrally with the door baskets 552 and may be mounted in the interior of the door baskets 552.

According to the fourth embodiment, the space occupied by the connecting duct 532 is minimized since the connecting duct 532 diverges from the uppermost portion of the fresh food duct 524 and along the lower wall 534*a* of barrier 534. Usually food stuffs are stored on the shelves mounted horizontally in the fresh food compartment 520 so that the space occupied by the connecting duct 532 is not suitable for food storage anyway.

The connecting duct 532 may be formed integrally with either the fresh food duct 524 or lower wall 534*a* of the barrier 534. In that case, the assembling process for the connecting duct 532 will be very simple, thereby reducing additive process steps.

Figure 15:
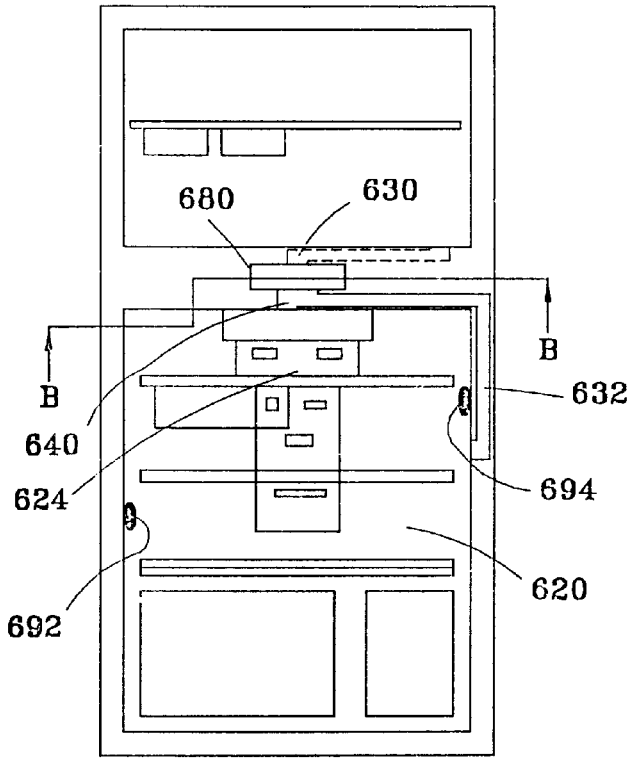
FIG. 15 is a front view of a refrigerator in accordance with a fifth embodiment of the invention with its door removed.
Figure 16:
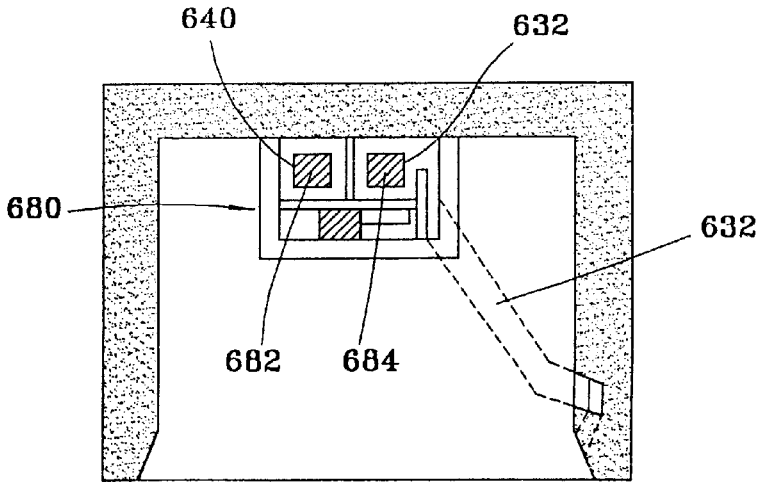
FIG. 16 is a section view taken along the line B—B in FIG. 15.

With reference to FIGS. 15 and 16, another embodiment for controlling refrigerated air will be described according to the present invention. As shown in FIGS. 15 and 16, a damper device 680 is installed at a point in which a connecting duct 632 diverges from a passageway 630. The passageway 630 is a duct, path, or the like for guiding refrigerated air to the fresh food compartment 620 through a path or duct 640 and a fresh food duct 624. The connecting duct 632 is a duct for delivering a portion of refrigerated air to the door duct described above. The damper device 680 controls an amount of air flow to the connecting duct 632 and to the path 640, respectively.

A detailed description on the internal structure of the damper device 680 is omitted herein since the damper device 680 is known and there are various known damper devices which control the amount of air flow in ducts.

Refrigerated air generated by the evaporator (not shown) is guided into the passageway 630, and then flows into the path 640 and connecting duct 632, respectively. The damper device 680 is mounted in the passageway 630 where it is divided into the path 640 and connecting duct 632, thereby controlling the amount of flow of refrigerated air, respectively. In this embodiment, the damper device 680 is provided with a pair of baffles 682, 684 which open and close the path 640 and connecting duct 632. The damper device 680 illustrated schematically is a "twin damper" having a pair of baffles.

The baffle 682 controls the amount of refrigerated air which flows into the fresh food compartment 620 through the path 640 and fresh food duct 624. And the baffle 684 controls the amount of refrigerated air which flows into the door duct through the connecting duct 632.

It will be understood that each damper device can be mounted either in the passageway 640 or the connecting duct 632, respectively.

The damper device 680 is controlled by a microprocessor (not shown) which is mounted in the refrigerator. Control of the baffle 684 in the damper device 680, which controls the amount of air flow of connecting duct 632, is carried out on the basis of a temperature sensed by a sensor 694 which is mounted in a door-adjacent portion. The control of the baffle 682 in the damper device 680, which controls the amount of air flow of passageway 640, is carried out on the basis of a temperature sensed by a sensor 692 mounted in the fresh food compartment 620. For example, when the temperature sensed by the sensor 694 is greater than a desired temperature, the microprocessor controls the baffle 684 of the damper device 680 to be opened, thereby providing refrigerated air in the door adjacent portion. In case that a pair of separate damper devices are mounted in the connecting duct 632 and passageway 640 respectively, the same control for the damper devices will be carried on the basis of the temperatures respectively sensed by the sensors 692, 694.

As illustrated and explained above, according to the embodiments of the air supply apparatus of the invention, refrigerated air is provided into the fresh food compartment by the fresh food duct and door duct. This means that the refrigerated air is spouted in the fresh food compartment forwardly and rearwardly, simultaneously, and this improves effective uniform cooling of the fresh food compartment.

Furthermore, the connecting duct which delivers refrigerated air to the door duct is mounted in the interior of insulation barrier or in the interior of the side wall of fresh food compartment. This provides sufficient storage space in the fresh food compartment because the connecting duct does not occupy any space in the food storage space, e.g., in the fresh food compartment. When the connecting duct is mounted along the lower wall of the barrier, a sufficient storage space is provided since the space occupied by the connecting duct is generally not utilized as the storage space anyway.

Conventional problems such as dewing and freezing on the outer surface of connecting duct can be overcome by providing the connecting duct in the interior of barrier or in the interior of side wall, or by at least mounting the insulation layer on the connecting duct according to the embodied invention.

The apparatus according to this invention provides refrigerated air concentrated in the door-adjacent portion by the door duct when the door is closed, thereby cooling the door-adjacent portion promptly. Accordingly, food stored in a door adjacent portion in the fresh food compartment will be kept fresh in spite of the frequent opening of the door.

Moreover, the food stored in the door basket, which is exposed to relative warm air when the door is opened, can be kept fresh by forming the outlet openings of the door duct so that refrigerated air spouted therefrom passes across the food stored in the door basket.

While specific embodiments of the invention have been illustrated and described herein, it is realized that modifications and changes can be made by those skilled in the art to which the invention pertains without departing from the scope of the invention. It is therefore to be understood that the appended claims are intended to cover all such modifications and changes as they fall within the true spirit and scope of the invention.

What is claimed is:

1. A refrigerated air supply apparatus for a refrigerator having a fresh food compartment, a freezer compartment, a barrier layer formed between the compartments and separating the compartments from each other, and at least one door for providing access to the compartments, the apparatus comprising:

a generator for generating refrigerated air;

a passageway formed in the barrier layer and transporting the refrigerated air received from said generator;

a fresh food compartment duct communicating with said passageway and providing the refrigerated air from the passageway into the fresh food compartment;

a connecting duct extending from the passageway towards a front portion of the fresh food compartment, and formed within the barrier layer, said connecting duct receiving the refrigerated air from said passage; and a door duct coupled to said one door for spouting the refrigerated air from said connecting duct into the fresh food compartment.

2. A refrigerated air supply apparatus as claimed in claim 1, wherein said door duct includes at least one horizontal portion which has a plurality of outlet openings for spouting the refrigerated air therethrough.

3. A refrigerated air supply apparatus as claimed in claim 2, wherein said at least one horizontal portion is mounted adjacent to a shelf which is mounted on said one door.

4. A refrigerated air supply apparatus as claimed in claim 2, wherein said at least one horizontal portion is mounted in the interior of a shelf which is mounted on said one door.

5. A refrigerated air supply apparatus as claimed in claim 1, further comprising;

a first damper device mounted in the connecting duct, and a first sensing unit for sensing the temperature of portions adjacent said one door, said first damper device being controlled based on the temperature sensed by the first sensing unit.

6. A refrigerated air supply apparatus as claimed in claim 5, further comprising:

a second damper device mounted in the passageway, and a second sensing unit for sensing the temperature of the fresh food compartment, said second damper device being controlled based on the temperature sensed by the second sensing unit.

7. A refrigerated air supply apparatus as claimed in claim 6, wherein the first damper device and the second damper device form a twin damper assembled integrally, said twin damper being mounted in the passageway where the connecting duct begins to diverge from the passageway.

8. A refrigerated air supply apparatus as claimed in claim 1, wherein said door duct is formed within said one door.

9. A refrigerated air supply apparatus as claimed in claim 1, wherein said door duct includes a vertical portion vertically extending and formed within a vertical edge portion of said one door.

10. A refrigerated air supply apparatus as claimed in claim 1, wherein said door duct includes an opening for directly receiving the refrigerated air from said connecting duct, said opening formed at a top edge portion of said one door.

11. A refrigerated air supply apparatus as claimed in claim 1, wherein said door duct includes an opening for directly receiving the refrigerated air from said connecting duct, said opening formed at a side portion of said one door.

12. A refrigerated air supply apparatus as claimed in claim 1, wherein an end portion of said connecting duct protrudes at a slant angle from an inclined front surface of the fresh food compartment.

13. A refrigerated air supply apparatus for a refrigerator having a fresh food compartment and a freezer compartment partitioned by an insulation barrier, and at least one door for accessing the compartments, the apparatus comprising:

a generator for generating refrigerated air;

a passageway formed in the insulation barrier and guiding the refrigerated air from the generator;

a fresh food compartment duct for providing the refrigerated air from the passageway into the fresh food compartment and extending downwardly in a back portion of the fresh food compartment;

a connecting duct diverged from an upper portion of the fresh food compartment duct and extending forwardly towards a front middle portion of the fresh food compartment; and a door duct mounted in said one door for spouting the refrigerated air from said connecting duct, the door duct including a vertical portion vertically extending across said one door.

14. A refrigerated air supply apparatus as claimed in claim 13, wherein said door duct further includes at least one horizontal portion horizontally extending from the vertical portion.

15. A refrigerated air supply apparatus as claimed in claim 14, wherein said at least one horizontal portion is mounted adjacent to a shelf mounted on said one door.

16. A refrigerated air supply apparatus as claimed in claim 14, wherein said at least one horizontal portion is mounted in the interior of a door basket mounted on said one door for storing food therein.

17. A refrigerated air supply apparatus as claimed in claim 13, wherein said fresh food compartment duct is formed on a middle portion of a back surface of the fresh food compartment.

18. A refrigerated air supply apparatus as claimed in claim 13, wherein the upper portion of said fresh food compartment duct and an upper vertical portion of said door duct directly contact each other when said one door is closed.

19. A refrigerated air supply apparatus for a refrigerator having a fresh food compartment and a freezer compartment partitioned by an insulation barrier, and at least one door for accessing the compartments, the apparatus comprising:

a generator for generating refrigerated air;

a passageway formed in the insulation barrier and guiding the refrigerated air from the generator; and a connecting duct extending from said passageway through the insulation barrier and through the interior of a side wall of the fresh food compartment, said connecting duct having an opening formed at an inner surface of the side wall of the fresh food compartment.

20. A refrigerated air supply apparatus of claim 19, further comprising:

a cover covering said opening of said connecting duct to be substantially flush to said inner surface of the side wall of the fresh food compartment, said cover allowing the refrigerated air from said connecting duct to pass therethrough.

21. A refrigerated air supply apparatus of claim 19, further comprising:

a fresh food compartment duct for providing the refrigerated air from the passageway into the fresh food compartment, said fresh food compartment duct extending downwardly in a back portion of the fresh food compartment.

22. A refrigerated air supply apparatus of claim 19, wherein said one door is without any door duct through which the refrigerated air from said connecting duct passes.

* * * * *